United States Patent [19]

Bakker et al.

[11] Patent Number: 4,707,915

[45] Date of Patent: Nov. 24, 1987

[54] DRY-SHAVING APPARATUS WITH ANGLED BLADES

[75] Inventors: Eppe Bakker; Albert Hoekstra, both of Drachten, Netherlands

[73] Assignee: U.S. Philips Corporation, New York, N.Y.

[21] Appl. No.: 943,475

[22] Filed: Dec. 16, 1986

[30] Foreign Application Priority Data

Dec. 20, 1985 [NL] Netherlands ..... 8503520

[51] Int. Cl.[4] ..... B26B 19/14

[52] U.S. Cl. ..... 30/43.6; 30/346.51

[58] Field of Search ..... 30/43.6, 43.5, 43.4, 30/43.9, 43.92, 346.51

[56] References Cited

U.S. PATENT DOCUMENTS 2,332,405 10/1943 Smith ..... 30/43.6
2,375,521 5/1945 Boyd ..... 30/43.6 X
4,043,036 8/1977 Stevens et al. ..... 30/43.6

*Primary Examiner*—Douglas D. Watts

*Attorney, Agent, or Firm*—Thomas A. Briody; William J. Streeter; Rolf E. Schneider

[57] ABSTRACT

A dry-shaving apparatus comprises a housing having a holder for a shear plate with hair-entry apertures and a cutter which is rotatable about an axis of rotation and which comprises a carrier for cutting elements which are movable relative to the carrier, in which during rotation of the cutter, as part of a revolution, each point of a cutting edge at the end of a cutting element follows a constrained path which is defined by the shear plate and each point of a cutting edge follows a circular free path when the ends are clear of the shear plate. At the more advanced axial end of the first cutting element, viewed in the direction of rotation, the radius of a circular free path of the cutting edge is smaller than the distance from the axis of rotation to the corresponding portion of the shear plate at the location where at this end the free path changes into the constrained path, so that the cutter comes gradually into contact with the shear plate.

4 Claims, 4 Drawing Figures

DRY-SHAVING APPARATUS WITH ANGLED BLADES

The invention relates to a dry shaving apparatus comprising a housing having a holder for a shear plate formed with hair-entry apertures and a cutter which is rotatable about an axis of rotation which cutter comprises a carrier with cutting elements which are movable relative to the carrier and which at their radial ends each comprise a cutting edge which extends between two axial ends of the cutting element, one axial end being more advanced in the direction of rotation than the other axial end, and which cutter is partly surrounded by the shear plate, every point of a cutting edge at the end of a cutting element of the cutter, as it rotates, following, as part of a revolution, a constrained path defined by the shear plate and every point of a cutting edge following a circular free path about the axis of rotation when the radial ends are clear of the shear plate.

Such a dry-shaving apparatus is disclosed in for example, U.S. Pat. No. 3,710,442. At the transition where the ends of the cutting elements in this known apparatus change over from the free path to the constrained path the sudden contact between the cutting elements and the shear plate will give rise to undesired vibrations in the cutter, which may lead to damage to this cutter, the shear plate and other parts of the apparatus.

It is the object of the invention to mitigate this drawback and to this end the invention is characterized in that viewed in the direction of rotation at the more advanced axial end of the cutting element the radius of a circular free path of the cutting edge is smaller than the distance from the axis of rotation to the corresponding portion of the shear plate at the location where at said axial end the free path changes into the constrained path.

An embodiment of the invention will now be described in more detail, by way of example, with reference to the accompanying drawings. In the drawings FIG. 1 is a schematic longitudinal sectional view of a dry-shaving apparatus in accordance with the invention.

Figure 1:
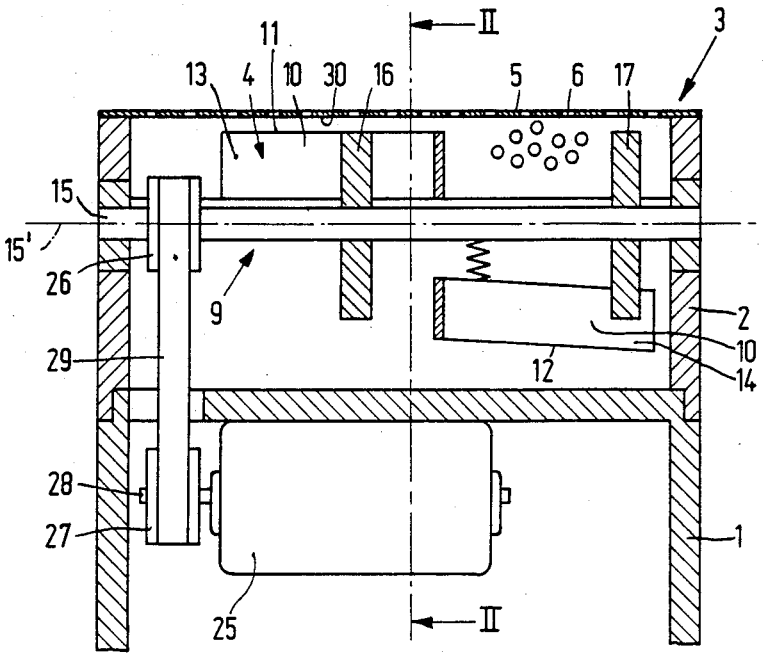
Figure 2:
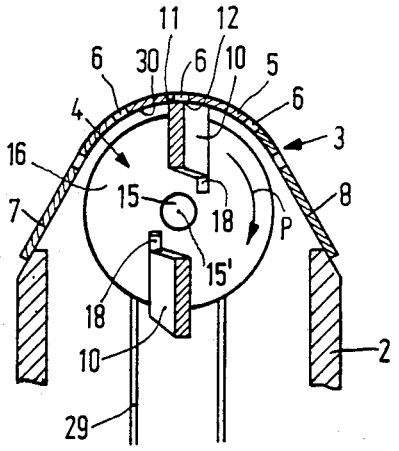
FIG. 2 is a part of a sectional view taken on the line II—II in FIG. 1.

The dry-shaving apparatus shown in the Figures comprises a housing 1 with a holder 2 for a shear plate 3 and a cutter 4 which is rotatable relative to the shear plate and which is partly surrounded by the shear plate.

The shear plate 3 comprises a central portion 5, curved as a circularly cylindrical surface and formed with hair-entry apertures 6 and also comprises peripheral portions 7 and 8 by which the shear plate is secured to the holder.

The cutter 4 comprises a carrier 9 and for example, two cutting elements 10 which are adjustable relative to the carrier. At its radial end 11 each cutting element 10 has a cutting edge 12 which extends between the two axial ends 13 and 14 of the cutting element.

Figure 3:
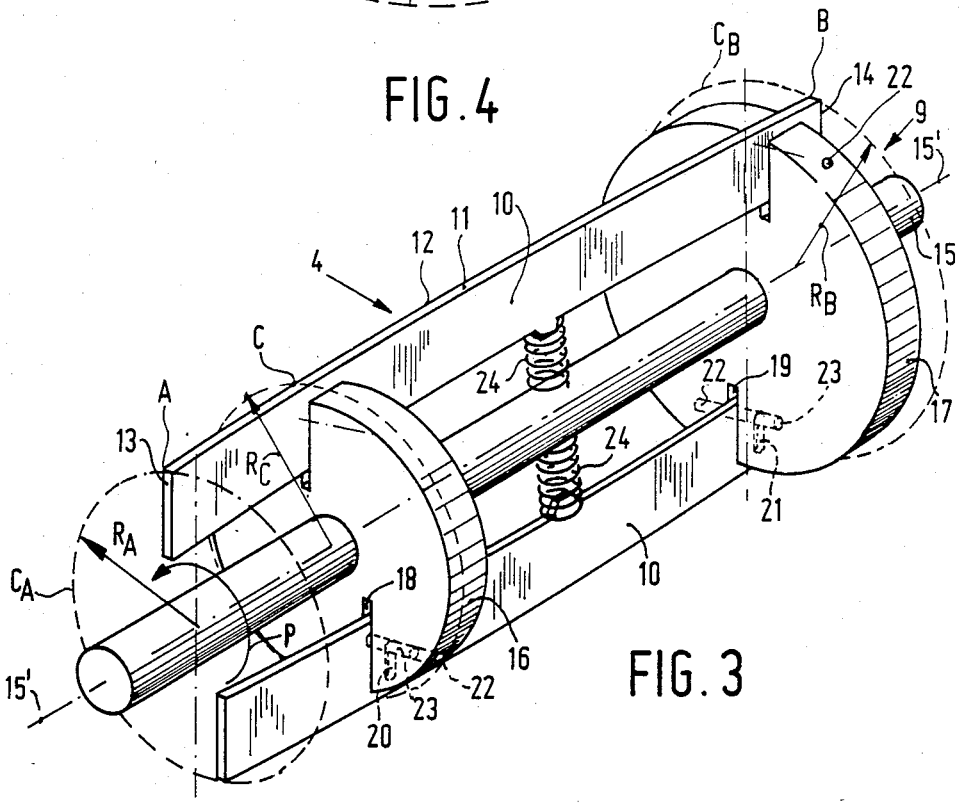
FIG. 3 is an enlarged-scale perspective view of the cutter used in the embodiment shown in FIGS. 1 and 2.

The carrier 9 comprises a spindle 15 and two discs 16 and 17 mounted on the spindle (FIG. 3). These discs are formed with substantially radial recesses 18 and 19 respectively for the cutting elements 10. At the location of the discs 16 and 17 the cutting elements 10 are formed with slots 20 and 21 respectively. Pins 23 mounted in bores 22 in the discs 16 and 17 extend through the slots 20 and 21 and bridge the recesses 18, 19. In this way the positions of the cutting elements 10 relative to the carrier 9 are radically adjustable to a limited extent. Pressure springs 24 are arranged between the spindle 15 and the cutting elements 10 to exert outwardly directed radial forces on the cutting elements 10.

The spindle 15 is supported in the holder 2 so as to be rotatable about the axis of rotation 15'. The housing 1 accomodates an electric motor 25 for driving the cutter 4. The rotation of the motor 25 is transmitted to the cutter 4 by means of pulleys 26 and 27, mounted on the spindle 15 and the motor shaft 28 respectively, and a drive belt 29 tensioned around these pulleys.

The cutting elements 10 which are not in contact with the shear plate 3 are urged outwards by the springs 24. The slots 20 (FIG. 3) are shorter than the slots 21, in such a way that the springs 24 urge the cutting elements 10 less far radially outwards at the location of the disc 16 than at the location of the disc 17. As a result of this, the cutting edges 12 are situated on a conical surface.

The recesses 18 and 19 are offset from each other in the direction of rotation so that in the direction of rotation indicated by the arrow P the axial end 13 is more advanced than the axial end 14 of the cutting element 10. The cutting edge 12 consequently has a helical shape.

Figure 4:
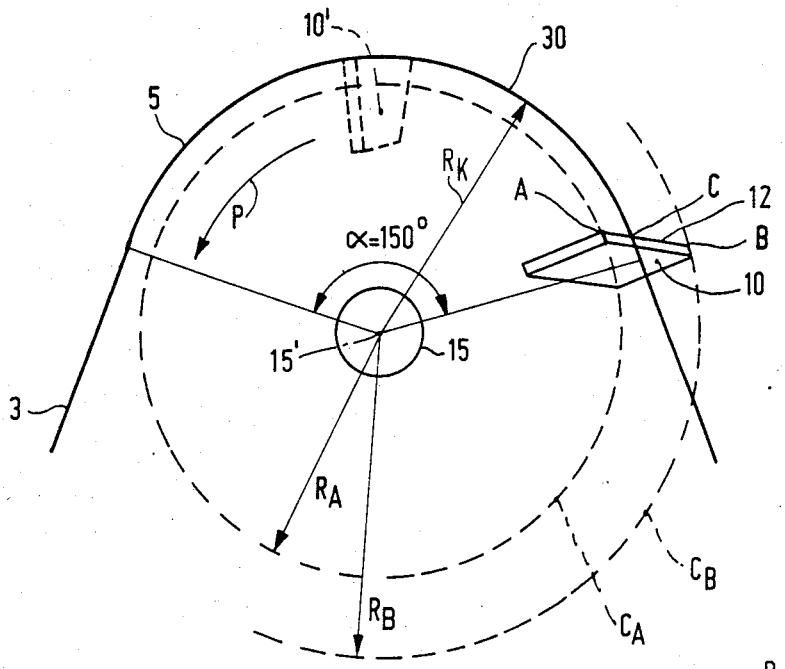
FIG. 4 is an enlarged-scale schematic cross-sectional view similar to FIG. 2, showing the shear plate and the cutter used in the embodiment shown in FIGS. 1 to 3.

When the cutter 4 is rotated a radial end 11 of a cutting element 10 will be in contact with the inner side 13 of the shear plate 3 during a part of a revolution (FIG. 4). During every revolution each point of the cutting edge 12 of the cutting element 10 will therefore follow a constrained path which is determined by the shear plate 3, and it will follow a free path when the end 11 is clear of the shear plate. This free path will be an arc of a circle having a centre situated on the axis of rotation 15' of the spindle 15.

The free path $C_A$ of a point A at the end 13 of a cutting element 10 will have a radius $R_A$ which is smaller than the radius $R_B$ of the free path $C_B$ of point B at the axial end 14 (see also FIG. 3).

In FIG. 4 the free paths $C_A$ and $C_B$ are represented by arcs of circles shown in broken lines. The central portion of the shear plate is represented as an arc of circle 5 having a central angle $\alpha$ of 150° and a centre situated on the axis of rotation 15'. The value of the radius $R_K$ of the central portion 5 is selected to lie between the values of $R_A$ and $R_B$.

For the direction of rotation P (FIG. 3) of the cutter 4 the axial ends 13 of the cutting elements 10 are more advanced and point A is the first point reaching the central portion 5 of the shear plate 3 from the free path. Since $R_A$ is smaller than $R_K$ or, generally speaking, $R_A$ is smaller than the distance from the axis of rotation 15' of the corresponding portion of the shear plate 3 at the location where the free path at the end 13 changes over to the constrained path, point A will initially be in contact with the inner side of the shear plate. The first contact between the cutting edge 12 and the inner side 30 of the portion 5 will be obtained at the location of point C where the radius $R_C$ of the free path is equal to $R_K$. As the rotation of the cutter 4 continues the pressure spring 24 will be compressed and the cutting element 10 will be tilted until the entire cutting edge 12 engages against the inner side 30 of the portion 5 of the shear plate 3. For a cutting element 10' this position is shown in broken lines in FIG. 4. In this way a gradual contact of the cutting element with the shear plate is obtained, thereby precluding vibration and collision effects. Since every cutting element 10 is in contact with the shear plate 3 for only a part of a revolution of the cutter 4, frictional losses are minimised. It is obvious that the same result can be obtained if the helically shaped cutting edges of the cutting elements are situated on a circularly cylindrical surface and the curved portion of the shear plate has the shape of a conical surface.

What is claimed is:

1. A dry shaving apparatus comprising a housing having a holder for a shear plate formed with hair-entry apertures and a cutter which is rotatable about an axis of rotation, which cutter comprises a carrier with cutting elements which are movable relative to the carrier and which at their radial ends each comprise a cutting edge which extends between two axial ends of the cutting element, one axial end being more advanced in the direction of rotation than the other axial end, and which cutter is partly surrounded by the shear plate, every point of a cutting edge at the end of a cutting element of the cutter, as it rotates, following, as part of a revolution a constrained path defined by the shear plate and every point of a cutting edge following a circular free path about the axis of rotation when the radial ends are clear of the shear plate, characterized in that viewed in the direction of rotation at the more advanced axial end of the cutting element the radius of a circular free path of the cutting edge is smaller than the distance from the axis of rotation to the corresponding portion of the shear plate at the location where at said axial end the free path changes into the constrained path.

2. A shaving apparatus as claimed in claim 1, characterized in that in the free path the cutting edges of the cutting elements are disposed on a conical surface and the curved portion of the shear plate is shaped as a cylindrical surface.

3. A shaving apparatus as claimed in claim 1, characterized in that in the free path the cutting edges of the cutting elements are disposed on a cylindrical surface and the curved portion of the shear plate is shaped as a conical surface.

4. A shaving apparatus as claimed in claim 1, characterized in that the cutting elements are manufactured as flat components of a sheet material.

* * * * *